US006900436B1

(12) United States Patent
Palmer et al.

(10) Patent No.: US 6,900,436 B1
(45) Date of Patent: May 31, 2005

(54) CORONA WIRE TENSIONING MECHANISM

(75) Inventors: Daniel R. Palmer, Rochester, NY (US); Gary B. Bertram, Honeoye Falls, NY (US); Warren G. Branch, III, Victor, NY (US)

(73) Assignee: Eastman Kodak Company, Rochester, NY (US)

( * ) Notice: Subject to any disclaimer, the term of this patent is extended or adjusted under 35 U.S.C. 154(b) by 562 days.

(21) Appl. No.: 09/688,002

(22) Filed: Oct. 14, 2000

(51) Int. Cl.[7] ..... H01T 19/00; H01T 19/04

(52) U.S. Cl. ..... 250/324; 250/325; 250/326; 361/230; 361/220

(58) Field of Search ..... 250/324, 325, 250/326; 317/282; 361/230, 229, 213

(56) References Cited

U.S. PATENT DOCUMENTS

| | | | | |
|---|---|---|---|---|
| 3,620,615 A | | 11/1971 | Volkers | |
| 3,908,127 A | * | 9/1975 | Clark | 250/325 |
| 4,104,521 A | | 8/1978 | Herrmann et al. | |
| 4,110,811 A | | 8/1978 | Hubble et al. | |
| 4,112,298 A | | 9/1978 | Weikel | |
| 4,320,957 A | | 3/1982 | Brown et al. | |
| 4,442,356 A | | 4/1984 | Ludwick et al. | |
| 4,453,293 A | | 6/1984 | Brückl | |
| 4,514,781 A | | 4/1985 | Plasschaert et al. | |
| 4,764,675 A | | 8/1988 | Levy et al. | |
| 4,782,732 A | * | 11/1988 | Kato et al. | 84/313 |
| 4,914,480 A | | 4/1990 | Endo | |
| 5,324,941 A | | 6/1994 | Gross et al. | |
| 5,339,137 A | | 8/1994 | Kusumoto et al. | |
| 5,424,540 A | | 6/1995 | Garcia et al. | |
| 5,449,906 A | | 9/1995 | Osbourne | |
| 5,539,205 A | | 7/1996 | Reale | |
| 5,627,376 A | | 5/1997 | Jaisinghani et al. | |
| 5,672,871 A | | 9/1997 | Jacobs et al. | |
| 5,857,132 A | | 1/1999 | Mizuishi et al. | |

OTHER PUBLICATIONS

European Search Report Dated Jan. 17, 2002 for patent No. 01121797.3 citing US 4,112,298A and US 4,453,293A patents listed above and attached hereto and referenced thereon as FRSA.a3467.

Original U.S. Appl. No. 09/438,160; Entitled: "Charger Wire Tensioning Mounting Mechanism and Method of Using".

Amendment to U.S. Appl. No. 09/438,160; Entitled "Charger Wire Tensioning Mounting Mechanism and Method of Using".

* cited by examiner

*Primary Examiner*—John R. Lee
*Assistant Examiner*—David A. Vanore
(74) *Attorney, Agent, or Firm*—Kevin L. Leffel; Richard A. Romanchik

(57) ABSTRACT

A wire tensioning mechanism for tensioning a wire having an end one and an end two in a machine in which the wire has a means for attachment on end two and is fixed to the machine at end one, comprises a slide block, and a spring.

The slide block is slidably mounted to the machine at end two of the wire, such that the slide block slides parallel to the wire. The slide block has a slot which is wider than the wire but narrower than the means for attachment, such that when the slide block is mounted on the machine, the wire end two can be slid into the slot such that pulling the slide block in the direction away from the wire forces the means for attachment against the slot, but does not allow the means for attachment to pass through. The slot is lined up with the wire such that when the wire is in tension, there are no side loads on the means for attachment.

8 Claims, 3 Drawing Sheets

CORONA WIRE TENSIONING MECHANISM

BACKGROUND

The present invention is in the field of electrophotographic printers and copiers. More specifically this invention relates to the corona charging device used to charge the surface of a photoconductor.

The corona charging device usually contains one or more small diameter (e.g. 0.003 inch diameter) corona wires. It is important that these wires be properly tensioned. Excessive tension can result in wire breakage, whereas insufficient tension can result in wire vibration and subsequent non-uniform charging of the photoconductor. Additionally, corona wires have a finite life and must be replaced in the field.

It is common practice to spring load corona wires to achieve the proper tension. One method used to do this is to crimp lugs onto the ends of the wires, secure one end of the wires, and then insert the lugs on the other end through the hook of an extension spring. Multiple wires may then be tensioned by mounting these springs on a tensioner block and rotating and securing the tensioner block at the desired tension. One drawback of this method is that it is difficult to maintain engagement between the lugs and the springs while rotating and securing the tension block. Another drawback is that because the spring and the corona wire are in direct contact in this method, the spring is at the same voltage as the wire, and there is a risk of arcing by the spring. One further problem with this method is that the force of the spring hooks can impart side loads on the lugs, which in turn can impose undue stress on the wires.

A corona wire tensioning mechanism is desired which would allow individual replacement of the corona wires, which would not impart side loads on the wires, and which would easily maintain engagement between the wire and the tensioning mechanism and yet be isolated from the spring so as to minimize the danger of arcing by the spring.

SUMMARY OF THE INVENTION

A wire tensioning mechanism for tensioning a wire having an end one and an end two in a machine, wherein the wire has a means for attachment on end two and is fixed to the machine at end one, comprises a slide block, and a spring.

The slide block is slidably mounted to the machine at end two of the wire, such that the slide block slides parallel to the wire. The slide block has a slot which is wider than the wire but narrower than the means for attachment, such that when the slide block is mounted on the machine, the wire end two can be slid into the slot such that pulling the slide block in the direction away from the wire forces the means for attachment against the slot, but does not allow the means for attachment to pass through. The slot is lined up with the wire such that when the wire is in tension, there are no side loads on the means for attachment.

DETAILED DESCRIPTION

This invention discloses a means for spring loading the wire 6 without actually attaching the spring 40 to the wire 6. This minimizes the risk of arcing from the spring 40 to the wire 6 and to other components within the machine. This improvement also minimizes side loads on the wire 6 by distributing the force on the attachment means 3, such as a lug, all the way around the attachment means 3.

Figure 1:
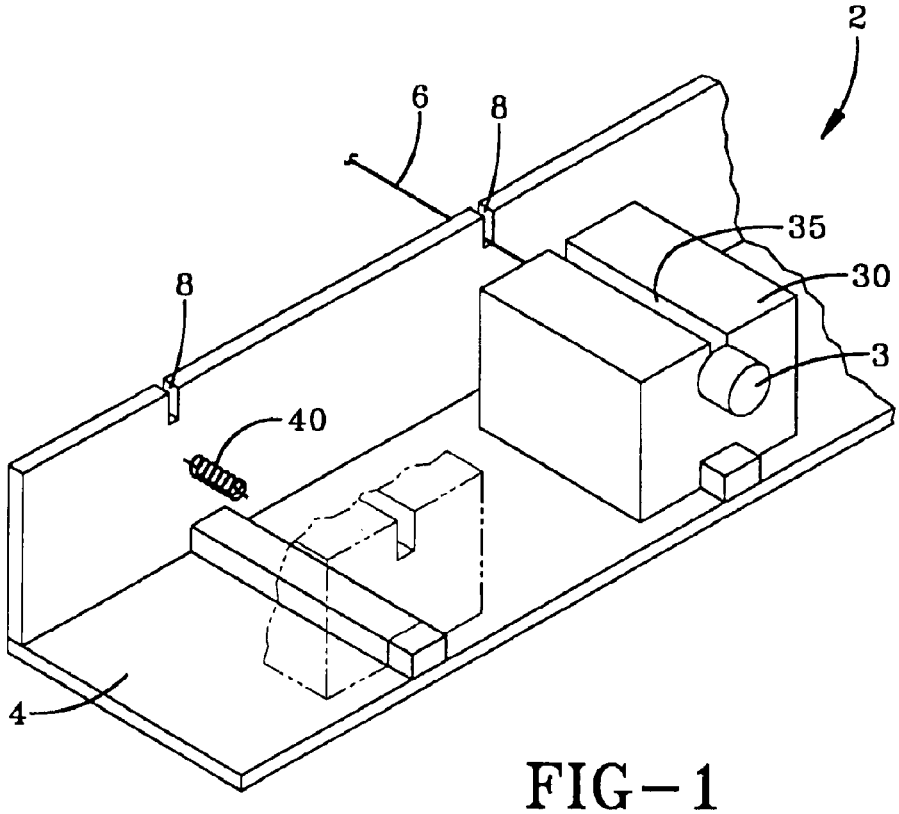
FIG. 1 is an isometric view of a wire tensioning device according to an aspect of the invention.

Various aspects of the invention are presented in FIGS. 1–5 which are not drawn to scale and in which like components are numbered alike. Referring now to FIG. 1 according to an aspect of the invention, a wire tensioning mechanism 2 for tensioning a wire 6 having an end one (not shown) and an end two 7 (see FIGS. 2–3) in a machine 4 wherein the wire 6 has a means for attachment 3 on end two 7 and is fixed to the machine 4 at end one, comprises a slide block 30, and a spring 40.

The slide block 30 is slidably mounted to the machine 4 at end two 7 of the wire, such that the slide block 30 slides parallel to the wire 6. The slide block 30 has a slot 35 which is wider than the wire 6 but narrower than the means for attachment 3, such that when the slide block 30 is mounted on the machine 4, the wire end two 7 can be slid into the slot 35 such that pulling the slide block 30 in the direction away from the wire 6 forces the means for attachment 3 against the slot 35, but does not allow the means for attachment 3 to pass through. The slot 35 is lined up with the wire 6 such that when the wire 6 is in tension, there are no side loads on the means for attachment 3. In a preferred embodiment, the means for attachment 3 is a lug crimped on the wire end two 7.

In order to align the wire 6 to the desired direction, the machine 4 will often have grooves 8 where the wire must lay. In this case, the slide block 30 is preferably slightly offset from the groove 8 in order to register the wire 6 against the groove 8 such that the wire 6 doesn't move.

The spring 40 is mounted between the machine 4 and the slide block 30 such that the spring 40 exerts a force on the slide block 30 in the opposite direction of the force which the tensioned wire 6 exerts on the slide block 30. The force of the spring 40 can cause the slide block 30 to slide, and the spring 40 is chosen such that the force exerted on the slide block 30 causes the wire 6 to achieve the desired tension. Thus the spring 40 forces the slide block 30 to pull on the wire 6.

Figure 2:
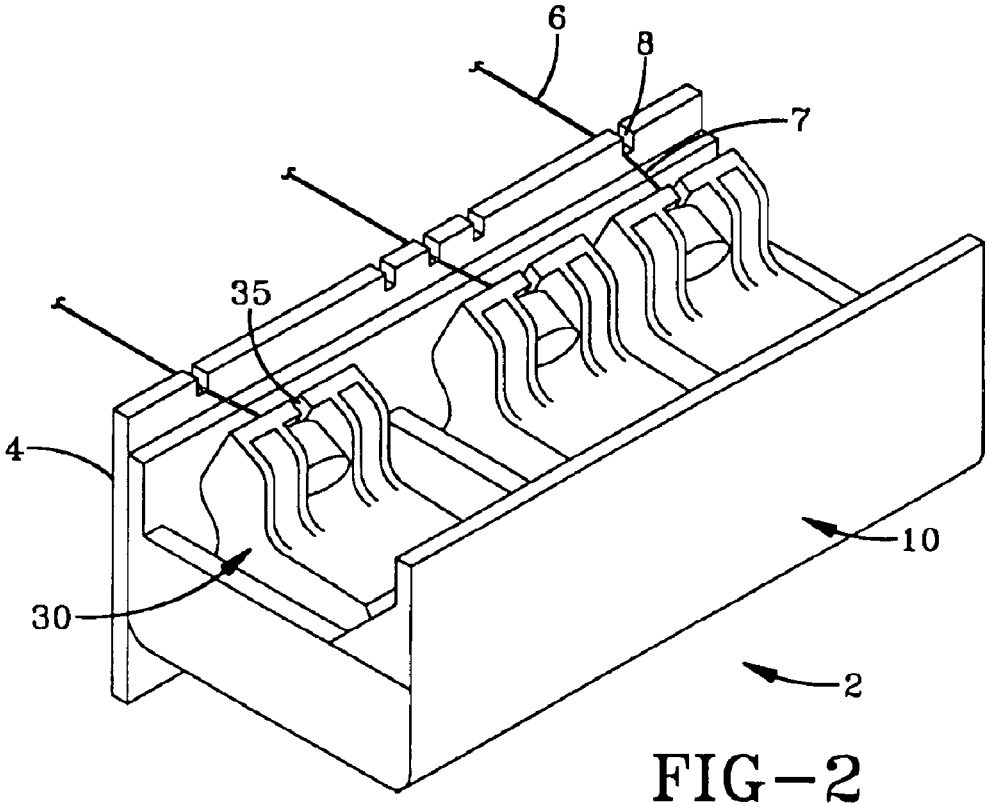
FIG. 2 is an isometric view of a wire tensioning device according to a further aspect of the invention.
Figure 3:
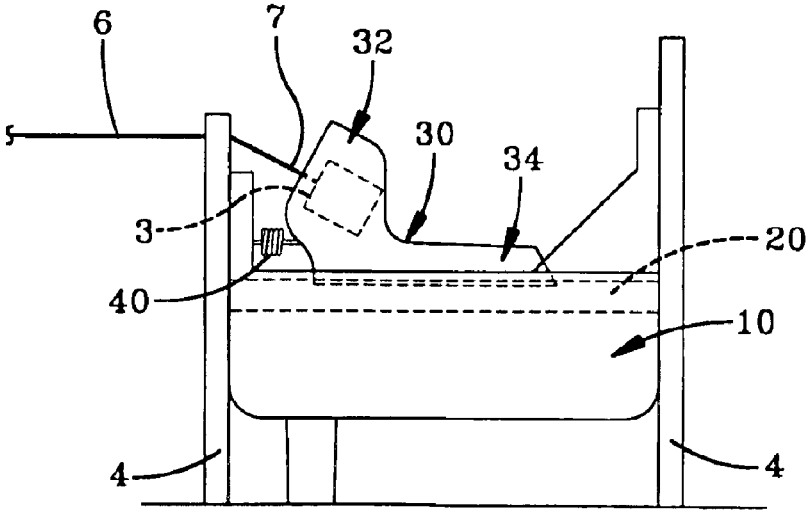
FIG. 3 is a side view of a wire tensioning device according to an aspect of the invention.
Figure 4:
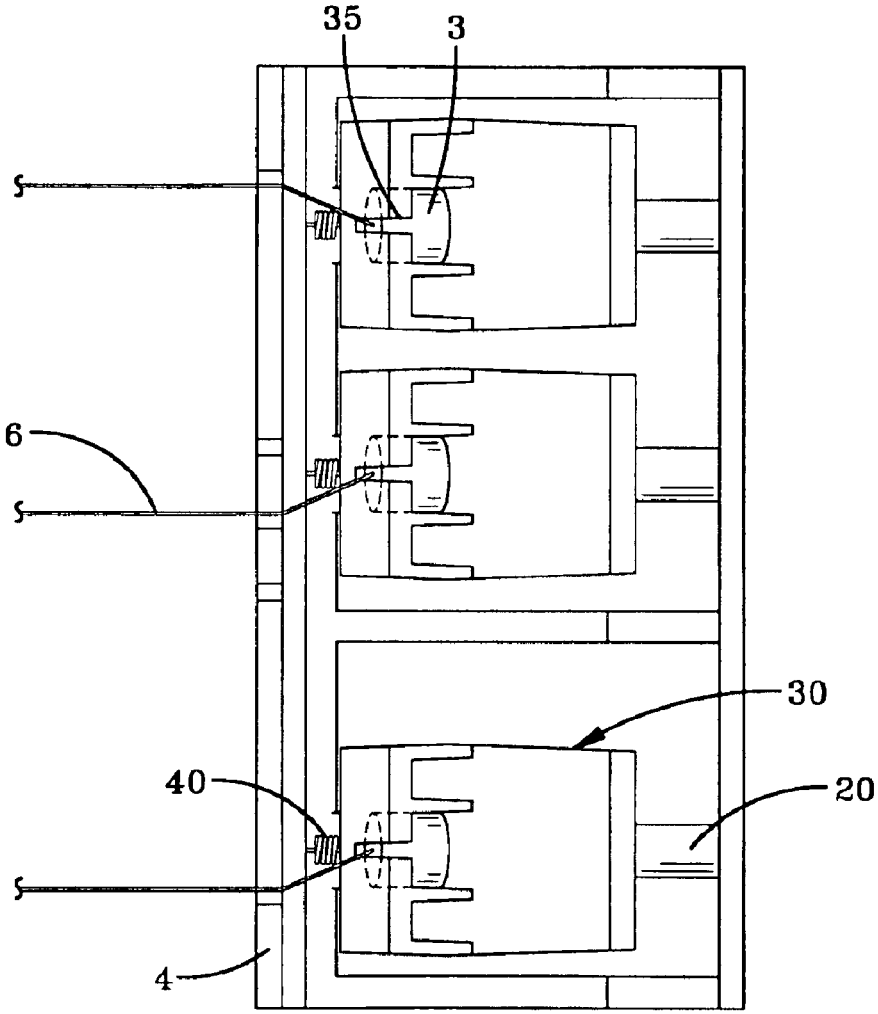
FIG. 4 is a top view of a wire tensioning device, according to an aspect of the invention.

Referring now to FIGS. 2–4, in a preferred embodiment of the invention, the wire tensioning mechanism 2 further comprises a holder 10 which is mounted to the machine 4. In this embodiment, the slide block 30 is slidably mounted to the holder 10. A preferred means of slidably mounting the slide block 30 to the holder 10 is to use a slide pin 20, wherein the slide pin 20 is mounted to the holder 10. A slide pin 20 may be mounted directly to the machine 4, wherein the slide block 30 is slidably mounted to the machine 4 on the slide pin 20 (this configuration is not shown).

When a holder 10 is incorporated, the spring 40 may be mounted between the machine 4 and the slide block 30, or between the holder 10 and the slide block 30 (this configuration not shown). The preferred embodiment is to have the spring 40 mounted between the slide block 30 and the holder 10.

In a further preferred embodiment, the slide block 30 is v-shaped, and the v-shaped slide block 30 comprises a leg one 34 and a leg two 32 (this is best seen in FIG. 3). Slide block leg one 34 is slidably mounted to the machine 4, and leg two 32 is on the same side of leg one 34 as the wire 6 such that leg two 32 angles away from the wire 6. Thus the "v" is laying on one of its sides (leg one 34), and the slot 35 is in the other side of the "v" (leg two 32). The portion of the slide block 30 with the slot 35 angles away from the wire 6 in order to better keep the wire 6 from slipping out of the slot 35.

According to a further preferred embodiment, the spring 40 is a compression spring. Although a compression spring is preferred for space constraint reasons, a tension spring will also work.

In a typical electrophotographic machine, multiple corona wires are present.

Figure 5:
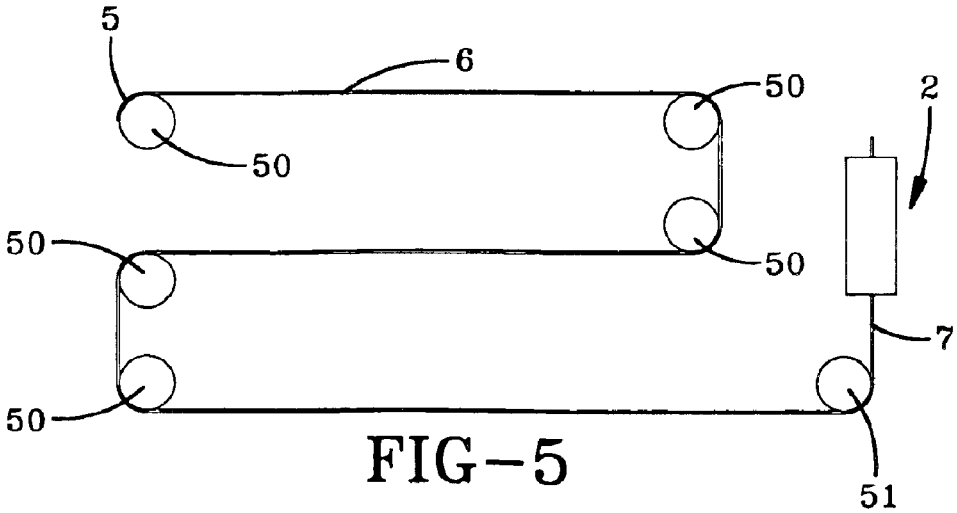
FIG. 5 is a top view of a continuous corona wire configuration with a wire tensioning device according to an aspect of the invention.

Referring now to FIG. 5, rather than have individual wires, according to a further aspect of the invention, a single continuous wire 6 may be used which would be strung in such a way as to create multiple segments. This continuous wire 6 would have an end one 5 and an end two 7, wherein end one 5 is secured against movement and end two 7 has a lug 3 crimped on. Wherein the necessary bends in the wire are achieved by wrapping the wire 6 around restraining devices 50, end two 7 is wrapped around the final restraining device 51 such that it makes an angle with the rest of the wire 6 of approximately 90°. End two 7 is then secured by a wire tensioning mechanism of the type described above. Many different types of restraining devices are acceptable; posts, pins, pulleys and grooves are all examples of restraining devices which may be used. However this invention is not limited to these specific examples, any device which acts to restrain the wire such that the wire may be bent into multiple segments may be used.

What is claimed is:

1. A wire tensioning mechanism for tensioning a wire having an end one and an end two, in a machine, wherein said wire is fixed to the machine at end one and has a means for attachment on end two, comprising:

a groove on the machine, wherein said end two of the wire is laid in said groove to align the wire to a desired position;

a slide block which is slidably mounted to the machine at the wire end two such that said slide block slides parallel to the wire, having a slot which is wider than the wire but narrower than the means for attachment such that when said slide block is mounted on the machine, the wire end two can be slid into said slot such that pulling said slide block in the direction away from the wire forces the means for attachment against the slot, but does not allow the means for attachment to pass through a spring which is mounted between the machine and said slide block such that said spring exerts a force on said slide block in the opposite direction of the force which the tensioned wire exerts on said slide block, such that the force of said spring can cause said slide block to slide, and wherein said spring is chosen such that the force exerted on said slide block causes the wire to achieve the desired tension.

2. The wire tensioning mechanism of claim 1 wherein said means for attachment is a lug which has been crimped on the wire.

3. A wire tensioning mechanism for tensioning a wire having an end one and an end two, in a machine, wherein said wire is fixed to the machine at end one and has a means for attachment on end two, comprising:

a slide block which is slidably mounted to the machine at the wire end two such that said slide block slides parallel to the wire, having a slot which is wider than the wire but narrower than the means for attachment such that when said slide block is mounted on the machine, the wire end two can be slid into said slot such that pulling said slide block in the direction away from the wire forces the means for attachment against the slot, but does not allow the means for attachment to pass through, and wherein said slot is lined up with the wire such that when the wire is in tension, there are no side loads on the means for attachment;

a spring which is mounted between the machine and said slide block such that said spring exerts a force on said slide block in the opposite direction of the force which the tensioned wire exerts on said slide block, such that the force of said spring can cause said slide block to slide, and wherein said spring is chosen such that the force exerted on said slide block causes the wire to achieve the desired tension; and, a slide pin which is mounted to the machine, wherein said slide block is slidably mounted to the machine on said slide pin.

4. The wire tensioning mechanism of claim 1 further comprising a holder, wherein said holder is mounted to the machine, and said slide block is slidably mounted to said holder.

5. The wire tensioning mechanism of claim 1 further comprising a holder wherein said holder is mounted to the machine, and said slide block is slidably mounted to said holder, and said spring is mounted between said slide block and said holder.

6. A wire tensioning mechanism for tensioning a wire having an end one and an end two, in a machine, wherein said wire is fixed to the machine at end one and has a means for attachment on end two, comprising:

a slide block which is slidably mounted to the machine at the wire end two such that said slide block slides parallel to the wire, having a slot which is wider than the wire but narrower than the means for attachment such that when said slide block is mounted on the machine, the wire end two can be slid into said slot such that pulling said slide block in the direction away from the wire forces the means for attachment against the slot, but does not allow the means for attachment to pass through, and wherein said slot is lined up with the wire such that when the wire is in tension, there are no side loads on the means for attachment;

a spring which is mounted between the machine and said slide block such that said spring exerts a force on said slide block in the opposite direction of the force which the tensioned wire exerts on said slide block, such that the force of said spring can cause said slide block to slide, and wherein said spring is chosen such that the force exerted on said slide block causes the wire to achieve the desired tension;

a holder, wherein said holder is mounted to the machine; and, a slide pin which is mounted to said holder, and wherein said slide block is slidably mounted to said holder on said slide pin.

7. A wire tensioning mechanism for tensioning a wire having an end one and an end two, in a machine, wherein said wire is fixed to the machine at end one and has a means for attachment on end two, comprising:

a slide block which is slidably mounted to the machine at the wire end two such that said slide block slides parallel to the wire, having a slot which is wider than the wire but narrower than the means for attachment such that when said slide block is mounted on the machine, the wire end two can be slid into said slot such that pulling said slide block in the direction away from the wire forces the means for attachment against the slot, but does not allow the means for attachment to pass through, and wherein said slot is lined up with the wire such that when the wire is in tension, there are no side loads on the means for attachment;

a spring which is mounted between the machine and said slide block such that said spring exerts a force on said slide block in the opposite direction of the force which the tensioned wire exerts on said slide block, such that the force of said spring can cause said slide block to slide, and wherein said spring is chosen such that the force exerted on said slide block causes the wire to achieve the desired tension; and, wherein said slide block is v-shaped, and wherein said v-shaped slide block comprises a leg one and a leg two, wherein said slide block leg one is slidably mounted to the machine, and wherein said leg two is on the same side of said leg one as the wire such that said leg two angles away from the wire, wherein said slot is in said leg two;

wherein said leg one and said leg two form an acute angle.

8. The wire tensioning mechanism of claim 1 wherein said spring is a compression spring.

* * * * *